US005862980A

United States Patent [19]

Samuelson

[11] Patent Number: 5,862,980

[45] Date of Patent: Jan. 26, 1999

[54] DISPLAY BOX

[75] Inventor: Leon C. Samuelson, Racine, Wis.

[73] Assignee: S. C. Johnson & Son, Inc., Racine, Wis.

[21] Appl. No.: 848,514

[22] Filed: Apr. 28, 1997

[51] Int. Cl.[6] ..... B65D 5/50

[52] U.S. Cl. ..... 229/104; 206/449; 211/50

[58] Field of Search ..... 206/425, 449, 206/555, 736; 211/50; 229/104, 105, 108, 111, 183

[56] References Cited

U.S. PATENT DOCUMENTS

| | | | |
|---|---|---|---|
| D. 191,143 | 8/1961 | Nabraski . | |
| D. 200,180 | 1/1965 | Korzaan . | |
| 820,542 | 5/1906 | Auerbach . | |
| 1,324,669 | 12/1919 | Harris | 229/104 |
| 1,732,436 | 10/1929 | Floto . | |
| 1,979,816 | 11/1934 | Andrews | 229/183 |
| 2,002,493 | 5/1935 | Einson | 229/104 |
| 2,110,600 | 3/1938 | Holcomb | 229/104 |
| 2,139,534 | 12/1938 | Williamson | 229/104 |
| 2,638,211 | 5/1953 | Spurr | 206/449 |
| 3,258,114 | 6/1966 | King | 206/449 |
| 3,884,410 | 5/1975 | Giesecke | 229/104 |
| 4,433,778 | 2/1984 | Maio et al. | 229/104 |
| 4,630,731 | 12/1986 | Albery | 206/425 |
| 4,951,813 | 8/1990 | Sauter . | |
| 5,522,538 | 6/1996 | Gray . | |

*Primary Examiner*—Jim Foster
*Attorney, Agent, or Firm*—David J. Houser

[57] ABSTRACT

A box, and a blank sheet for forming the box, are disclosed. When assembled, the box includes a floor panel which slopes downwardly from a rear end to a front end, and a brace panel which cooperates with other display panels to support the elevated rear end of the floor panel.

3 Claims, 5 Drawing Sheets

FIG. 9
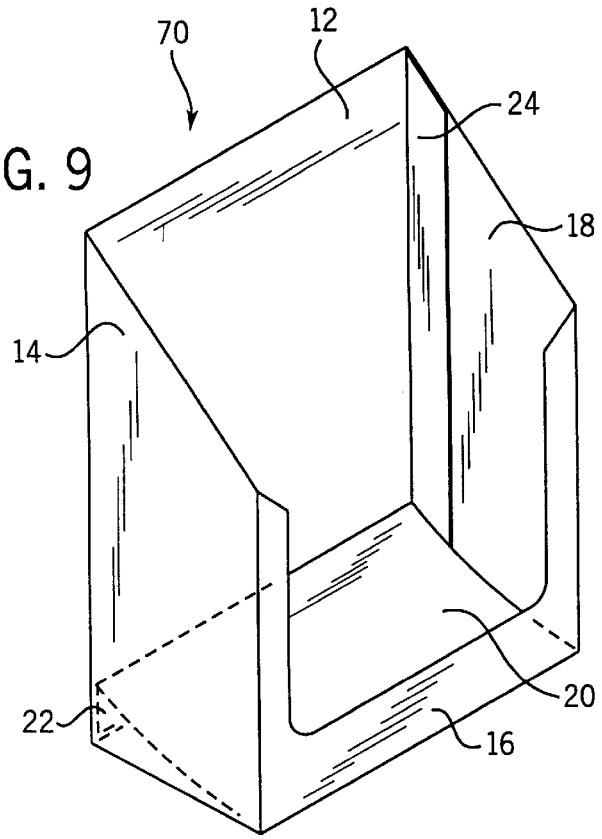
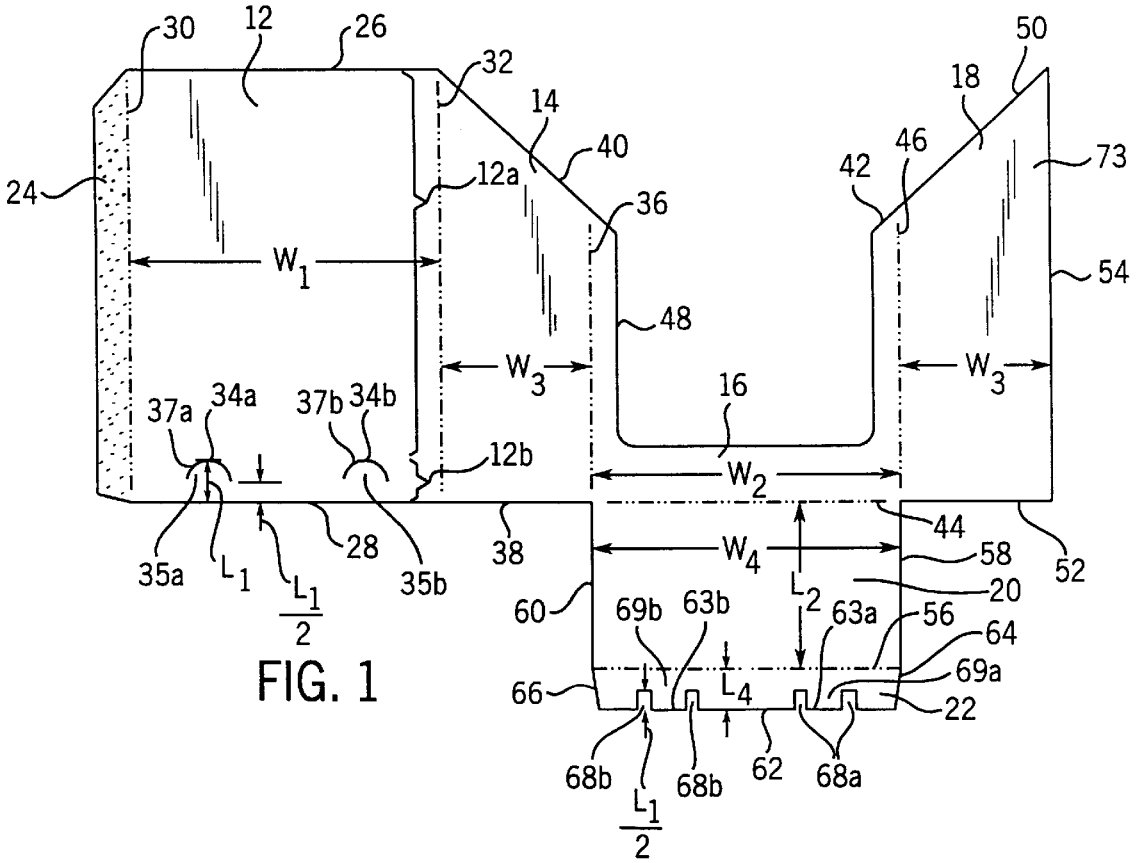
FIG. 1

FIG. 2
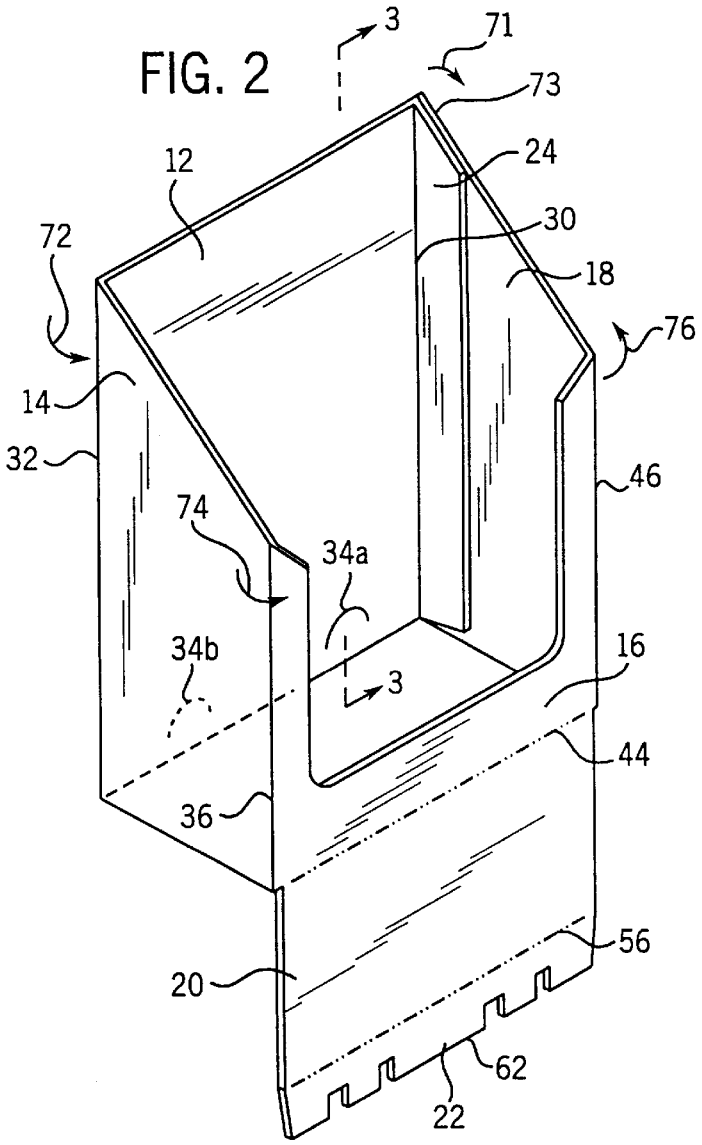
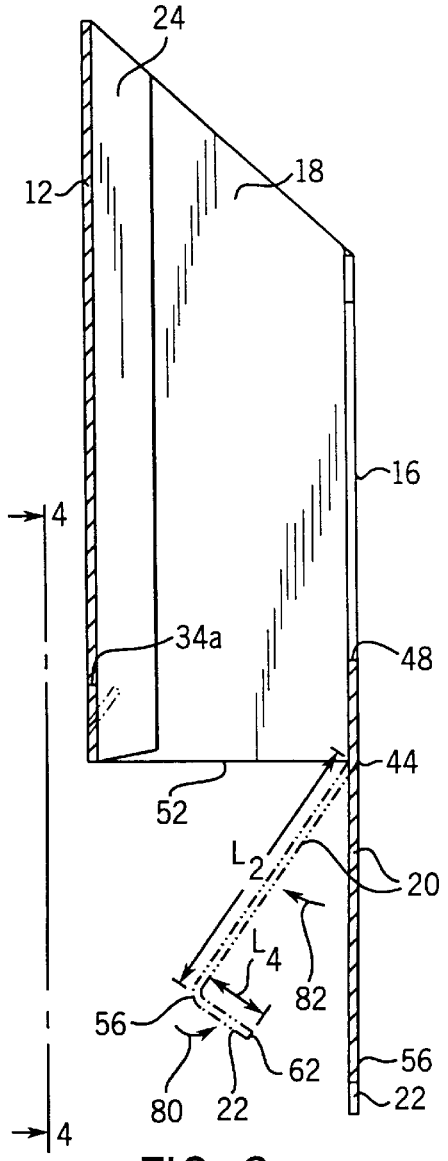
FIG. 3

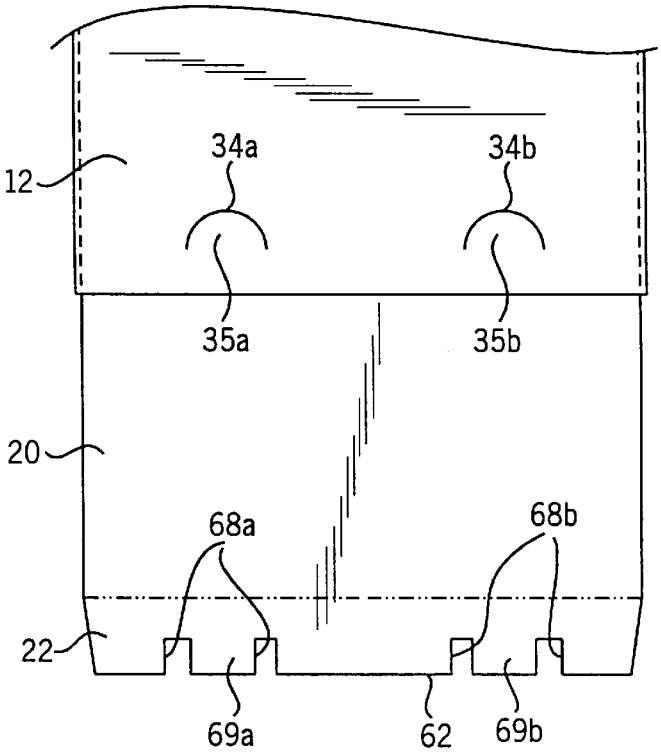
FIG. 4
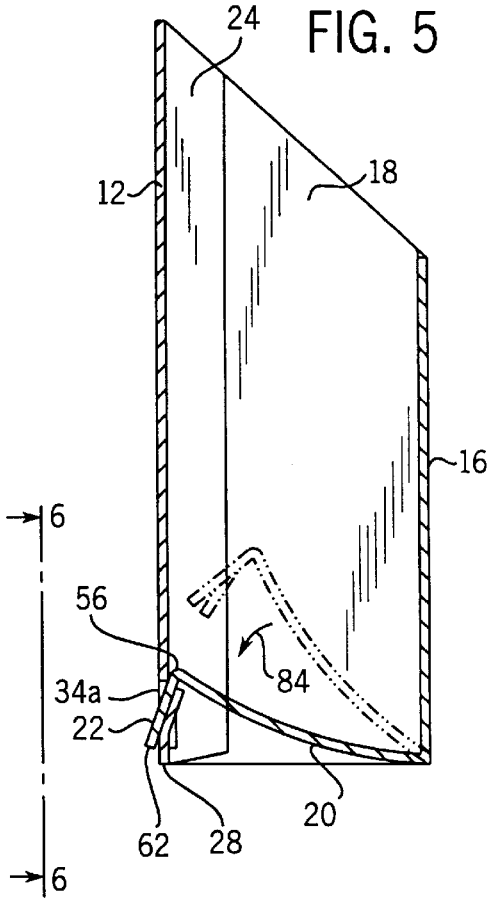
FIG. 5
FIG. 6
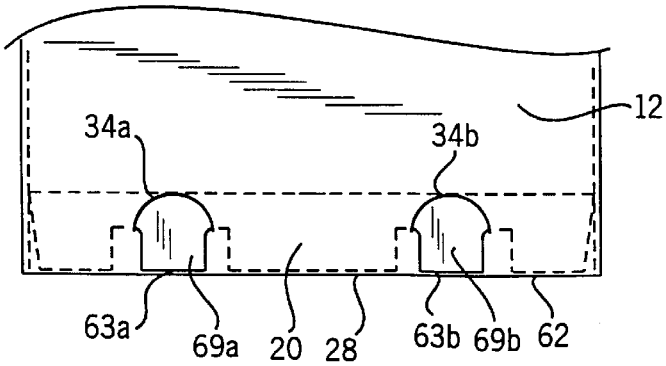

DISPLAY BOX

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates to display boxes useful in displaying one or more panel-like items, and more particularly to a display box formed from a single foldable blank and having a supported floor which slopes downwardly from a back end to a front end.

One common point of sale marketing technique is to place a product in informative and eye catching packaging. "Blister cards" provide particularly useful point of sale packaging for small products. A blister card includes a plastic transparent dome which is attached to a front surface of a relatively large cardboard panel. Product is packaged between the dome and the panel and is observable through the dome. Advertising information is provided on the panel's front surface. In some cases other product information (e.g. directions, ingredients, etc.) is provided.

Such blister cards are often provided with an upper aperture so that they can be hung on display pegs.

However, this requires the store to acquire and set up special peg areas.

A well designed blister card display should permit the product to be displayed anywhere in the store, and should also arrange cards such that the advertising material on the front surface of the front card is easily observable. In addition, it should maintain cards in an orderly arrangement and provide an overall quality appearance.

One prior art product display is a box with no top and with the upper portion of the front wall cut away. It has a horizontal floor. As such, when some products are removed from a front end of such a display, products at a rear end of the display can tip forward and be difficult to see. In any event, products in this type of display box can easily become disheveled.

More complex box displays have been designed that include a sloped lower floor panel which supports products at an angle for viewing. One such display is disclosed in U.S. Pat. No. 1,732,436 wherein a support member extends below a rear end of a box such that the entire box slopes downwardly toward the front. Unfortunately, the support member beneath the rear of the box must support the combined weight of the entire box and products displayed therein. Also, because the support member extends below the box, the support member is observable when the display is set up and the display has an unfinished and cheap look. Moreover, this display is formed from a relatively complex blank and the length of the floor is unnecessarily traversed more than once. This increases manufacturing and assembly costs.

Other box type displays have also been designed (see e.g. U.S. Pat. Nos. 820,542; D. 191,143; and D. 200,180). However, each suffers from one or more of the shortcomings associated with the display described above, and/or other shortcomings.

There is therefore a need for an improved and durable box type display which can maintain products in an ordered and easily viewable arrangement.

BRIEF SUMMARY OF THE INVENTION

The invention provides a blank sheet of foldable material for use in forming a display box having a sloped floor. The sheet includes a first panel having lateral edges and upper and lower edges, a second panel having lateral edges and upper and lower edges, a third panel integrally attached at a fold line to a lateral edge of the first panel and integrally attached at a fold line to a lateral edge of the second panel, the first and second panels being separated by the third panel.

A floor panel is integrally attached at a fold line to the lower edge of the first panel. There is also a brace panel having upper and lower edges. The brace panel upper edge is integrally attached at a fold line to an edge of the floor panel opposite the first panel. The blank also includes a securer at least in part on the brace.

The panels of the blank sheet are juxtaposed such that when the box is assembled by folding the sheet along the fold lines, at least the third panel is essentially vertical, and the first panel is opposite the second panel with the floor panel sloping therebetween. The securer then fastens the brace panel adjacent to the second panel.

In one aspect, the sheet further includes a fourth panel attached at a fold line to the first panel opposite the third panel, the edge of the fourth panel opposite the first panel being a distal edge. The sheet also includes an attachment panel linked at a fold line to a lateral edge of the second panel opposite the third panel. When the sheet is folded to form the box, the third panel is opposite the fourth panel and the attachment panel can be glued to the distal edge.

In a preferred embodiment, the second panel includes a lower section having at least one slit and the brace panel has a foot suitable to be received in the slit. The slit can be arc-like.

Alternatively, the lower section of the second panel and the brace panel can be considered to have brace components. The securer is formed by the brace components. A first of the brace components is at least one slit and a second of the brace components is at least one tab. When assembled, the tab can extend through the slit to secure the brace panel adjacent the second panel. Preferably, the slit is in the lower section of the second panel.

In another aspect the length of the tab is essentially the same as the distance between the bottom of the slit and the second panel lower edge. The slit can define a second tab having proximal and distal ends which extends upwardly. The length of the second tab is essentially the same as the distance between the first tab proximal end and the brace panel upper edge.

In another aspect, the invention provides a display box formed from the blank described above. The box has first and second panels each having upper and lower edges as well as first and second lateral edges. There is a third panel traversing the distance between a first panel lateral edge and a second panel lateral edge. A floor panel is integrally attached at a fold line to the first panel lower edge and a brace panel is attached to the floor panel opposite the first panel. The brace panel has upper and lower edges. A securer fastens the brace panel adjacent the second panel. When the brace panel is fastened to the second panel, the lower edge of the second panel and the brace panel are adjacent and the brace panel upper edge is vertically higher than the first panel lower edge. Also, at least the third panel is essentially vertical.

In a related aspect the third panel is a first lateral panel and the box further includes a second essentially vertical lateral panel opposite the first lateral panel that traverses the distance between the first and second panels.

It is therefore an object of the invention to provide a display box formed from a single foldable blank having panels that cooperate to support a floor panel in sloped configuration.

A related object is to provide a display box having a floor panel which slopes from a rear end downwardly toward a front end of the box, while providing an exterior appearance similar to that of a conventional box.

It is another object to provide an inexpensive single sheet blank for forming a durable display box having the features identified above.

A further object is to provide a box of the type set forth above which is easy to manufacture.

The foregoing and other objects and advantages of the invention will appear from the following description. The description makes reference to the accompanying drawings which form a part hereof, and in which there is shown by way of illustration the preferred embodiments of the invention. Such embodiments do not represent the full scope of the invention. Rather, reference should be made to the claims for interpreting the full scope of the invention.

BRIEF DESCRIPTION OF THE DRAWINGS

FIG. 1 is a plan view of a preferred embodiment of a paper blank that can be used to form a display box in accordance with the present invention;

FIG. 2 is a perspective view of the blank of FIG. 1, partially folded;

FIG. 3 is a cross-sectional view taken along line 3—3 of FIG. 2;

FIG. 4 is a fear view taken along line 4—4 of FIG. 3;

FIG. 5 is a cross-sectional view similar to FIG. 3, albeit with the display box being nearly fully assembled;

FIG. 6 is a rear view taken along line 6—6 of FIG. 5, albeit with the display being fully assembled;

FIG. 9 is a perspective view of a fully assembled display; and

DETAILED DESCRIPTION

Figure 7:
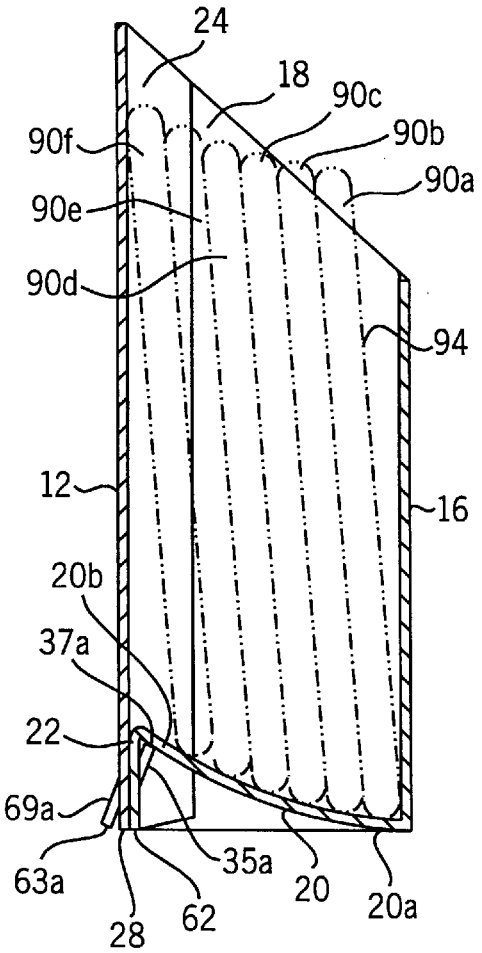
FIG. 7 is a cross-sectional view similar to FIG. 5 showing the display fully assembled and completely loaded with products.

FIG. 1 shows a blank 10 of thin gauge paperboard. When folded and assembled, blank 10 forms the display box 70 shown in FIG. 9.

Blank 10 is provided with a plurality of fold lines and perforated lines which together define various panels and flaps including a first (front) panel 16, a second (rear) panel 12, a third panel (also referred to as a first lateral panel) 14, a fourth (second lateral) panel 18, a floor panel 20, a brace panel 22, and glue (attachment) panel 24.

Panel 12 is generally rectangular and has an upper edge 26, a lower edge 28, a first lateral edge 30, a second lateral edge 32 and a width $W_1$. Panel 12 can be considered to have an upper section 12*a* and a lower section 12*b*. The lower section 12*b* has a length $L_1$, that extends from lower edge 28 toward upper edge 26. Lower section 12*b* has two slits 34*a* and 34*b*. Each slit 34*a* and 34*b* is crescent shaped and concave downwardly so as to define upwardly extending tabs 35*a*, 35*b* having ends 37*a*, 37*b*, respectively. In the illustrated embodiment, each tab 35*a*, 35*b* is approximately one-half the length of the lower section (i.e. $L_1/2$) and the distal ends 37*a*, 37*b* coincide with the upper boundary of lower section 12*b*.

The first lateral panel 14 has a first lateral edge defined by fold line 32, a second lateral edge defined by fold line 36, a lower edge 38 and an upper edge 40. The edge defined by fold line 32 is longer than the edge defined by fold line 36 so that, as illustrated, the upper edge 40 slopes downwardly from fold line 32 to fold line 36.

Panel 16 is generally U-shaped and has an upper edge 42, a lower edge defined by fold line 44, a first lateral edge defined by fold line 36, a second lateral edge defined by fold line 46 and a width $W_2$ which is identical to width $W_1$. The upper edge 42 defines an opening 48 which opens concavely upwardly.

Panel 18 (the fourth panel) is shaped like the mirror image of panel, 14 and has an upper edge 50, a lower edge 52, a first lateral edge 54 and a second lateral edge defined by fold line 46. Again, the two lateral edges 46, 54 are parallel and each forms a right angle with lower edge 52. Edge 54 is longer than edge 46 so that edge 50 slopes downwardly from the first lateral edge 54 to the second lateral edge 46. Both of the first and second lateral panels 14, 18 have a width $W_3$. Panel 18 has a distal end 73 along edge 54.

The floor panel 20 is rectangular and has an upper edge defined by fold line 44, a lower edge defined by fold line 56, a first lateral edge 58, a second lateral edge 60, a width $W_4$ identical to width $W_2$ and a length $L_2$ which is slightly greater than width $W_3$.

Brace panel 22 is generally rectangular and has an upper edge defined by fold line 56, a lower edge 62, a first lateral edge 64, a second lateral edge 66 and a length $L_4$ which is preferably identical to $L_1$. Panel 22 has recess pairs 68*a* and 68*b*, each recess pair 68*a*, 68*b* defining a downwardly extending tab/foot 69*a*, 69*b*, respectively. Each foot 69*a*, 69*b* is formed so that when blank 10 is assembled to form display box 70, the feet 69*a*, 69*b* are adjacent and can be received within slits 34*a* and 34*b*, respectively. Each foot 69*a*, 69*b* is one-half the length of lower section 12*b* (i.e. $L_1/2$) and has bottoms 63*a*, 63*b*, respectively, which, coincides with edge 62. Glue panel 24 is attached to panel 12 along fold line 30 opposite panel 14.

The surfaces of the panels and tab observable in FIG. 1 are external surfaces of the box, and the surfaces that are not observable are internal surfaces. Turning now to FIG. 2, in folding the blank 10 to form display 70, panel 14 is folded relative to panel 12 along fold line 32 in the direction illustrated by arrow 72 so that the internal surfaces of panels 12 and 14 form a 90° angle. First panel 16 is folded relative to panel 14 along fold line 36 in the direction indicated by arrow 74 15 until the internal surfaces of panels 14 and 16 form a 90° angle. At this point the internal surfaces of panels 12 and 16 should be parallel and opposed.

Glue panel 24 is folded in the direction indicated by arrow 71 until the internal surfaces of panel 12 and panel 24 define a 90° angle and the panel's internal surface opposes the internal surface of panel 14. Next, panel 18 is folded along fold line 46 as illustrated by arrow 76 until the internal surfaces of panels 18 and 16 define a 90° angle, the internal surfaces of panels 14 and 18 are opposed and the internal surface of distal end 73 rests on the external surface of panel 24.

Prior to folding panel 18, a strip of glue (not shown) is provided on the external surface of the panel 24 and/or on the internal surface of the distal end 73. Then, with the panels folded as indicated above, the internal surface of the distal end 73 can be compressed against the panel's external surface. In this way, when the glue cures, panel 24 and panel 18 will be secured such that lateral panels 14 and 18 are positioned opposite each other and panels 12 and 16, are positioned opposite each other.

Referring to FIGS. 2–4, at this point panels 12, 14 16 and 18 form vertical walls of a box wherein all internal panel surfaces face the internal space defined by the box. Brace panel 22 is then folded along fold line 56 (see phantom) as illustrated by arrow 80 such that the external surfaces of panels 22 and 20 define an angle that is less than 180°. Floor panel 20 is then folded along fold line 44 in the direction illustrated by arrow 82 such that the internal surfaces of floor panel 20 and first panel 16 define an angle that is less than 180°.

Referring next to FIG. 5, panel 20 is further folded along fold line 44 and is slightly bent so that edge 56 clears lower edge 28 of panel 12. A finger is used to separate tabs 35*a* and 35*b* from panel 12 by pushing on the external surface of tabs 35*a*, 35*b* so as to force the tabs 35*a*, 35*b* inwardly toward panel 16. Then, floor panel 20 is moved downwardly as illustrated by arrow 84 until edge 62 is at the top of lower section 12*b*.

Referring next to FIG. 6, by continuing to force panel 20 downwardly, because tabs 35*a* and 36*b* have been pushed inwardly toward panel 16, tabs 69*a* and 69*b* will pass between distal ends 37*a* and 37*b* and adjacent portions of lower section 12*b*. Floor panel 20 will continue downwardly until distal ends 37*a* and 37*b* contact the external surface of floor panel 20 and distal ends 63*a* and 63*b* are adjacent bottom edge 28 of panel 12.

Figure 8:
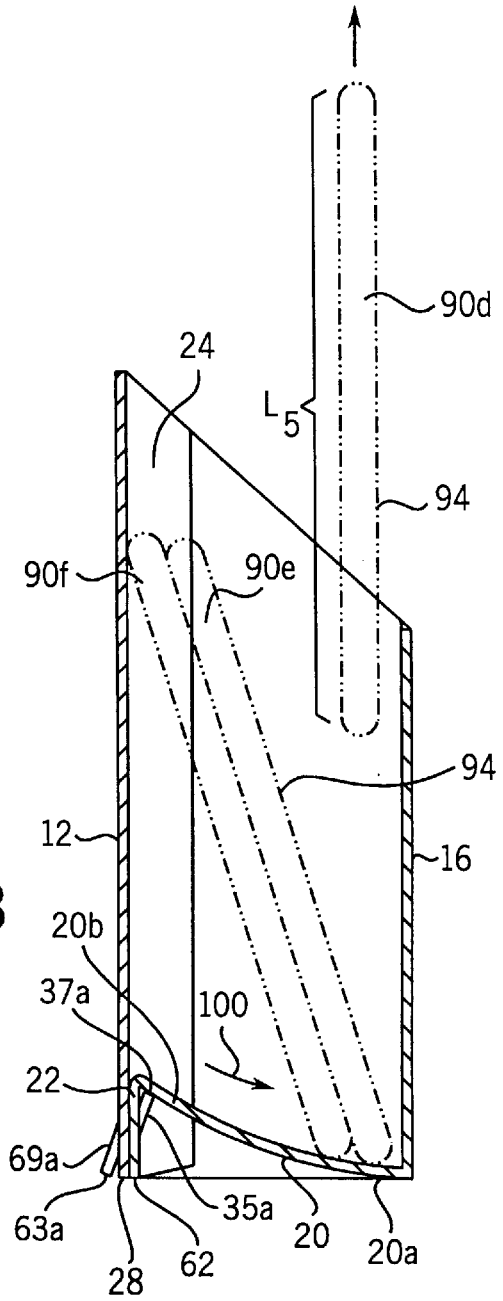
FIG. 8 is a cross-sectional view similar to FIG. 7, albeit with some of the product removed.

Referring to FIGS. 7 and 8, after the display 70 has been completely assembled, display products 90*a*–90*f* can be arranged in the display as illustrated. Preferred display products include generally planar items (e.g. pictures, playing cards, thin packs of gum, blister card packaged products, etc.).

Referring to FIGS. 1 and 8, the length $L_2$ of floor panel 20 should be appreciably less than a length $L_5$ of products 90*a*–90*f* displayed in box 70 so that when only a few products (see FIG. 8) remain in the box 70 they still will be in an upright (albeit sloped) position leaning back against panel 12 with their front surfaces 94 facing panel 16. Preferably length $L_2$ is approximately one-half or less than length $L_5$.

Referring to FIG. 7, with an assembled display fully loaded with display products, the lower edges of the products rest on the internal surface of floor panel 20. There is a certain amount of friction between the lower edge of each product and panel 20. Length $L_4$ of brace panel 22 is chosen such that the height of a rear end 20*b* of panel 20 above a front end 20*a* provides a slope which cooperates with gravity to overcome the friction. To this end, the ratio of $L_4$ to $L_2$ should be approximately 1 to 4 but could be in the range of 1 to 2 through 1 to 10 depending on the amount of friction between panel 20 and products 90*a*–90*f*.

Referring to FIG. 8, when length $L_4$ is properly chosen, when a product 90*d* is removed from the front portion of display 70, other products 72 within the display 70 slide forward as illustrated by arrow 100 and lean backward against panel 12 so that an observer observing the display 70 from in front of panel 16 through opening 48 always sees the front surface 94 (and advertisement material thereon) of at least one product 90*e*.

It should be appreciated that a simple, inexpensive, and durable blank (and display that can be formed by the blank) have been described. When the display is assembled, the display maintains products in an orderly and easily viewable arrangement because the floor panel 20 slopes downwardly from a rear end 20*b* to a front end 20*a* of the display 70.

Importantly, the elevated rear end 20*b* of floor panel 20 can be supported by at least two panels (e.g. the lower section 12*b* of panel 12 and the feet of brace panel 22). Moreover, portions of panels 14 and 18 adjacent the lower section 12*b* provide support for lower section 12*b* and thereby support elevated rear end 20*b*. Most importantly, the lower ends of panels 14 and 18 hide the sloped floor panel 20 and brace panel 22 thus producing a relatively clean, box-like appearance.

The above description has been that of a preferred embodiment of the present invention. It will occur to those who practice the art that many modifications may be made without departing from the spirit and scope of the invention. For example, various modifications beside those shown and discussed may be made with regard to the shape and size of the various panels and with regard to the location, shape, and size of the slits 34*a*, 34*b*, and tabs 69*a*, 69*b*. In this regard, only a single tab might be provided, or in the alternative more than two tabs can be provided. The securer might instead be glue.

In addition, the length of the tabs 69*a*, 69*b* could be altered so that the tabs are longer or shorter. Moreover, while the preferred embodiment is described as having an opening 48, that opening's size and shape could be altered or eliminated altogether. Furthermore, while the box is described as including first and second lateral panels 14, 18, the box may require only a single lateral panel and may not require glue strip 24. Also, the brace panel could be linked to the lateral rear of the second or fourth panel.

Figure 10:
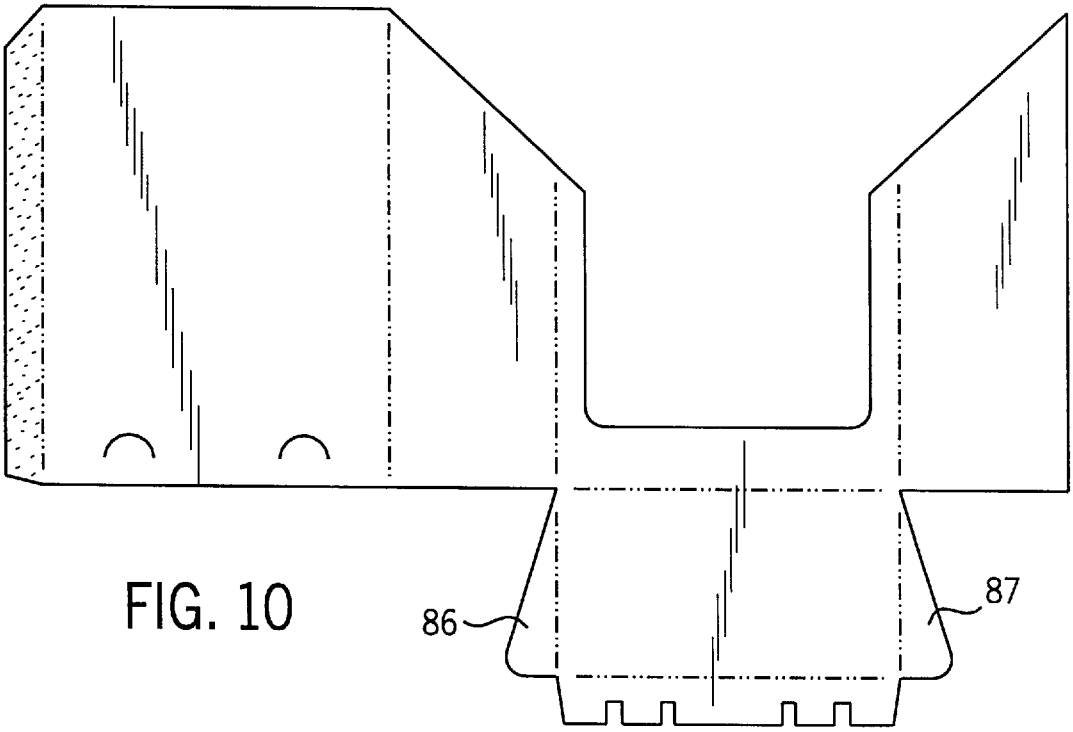
FIG. 10 is a plan view of a second embodiment, identical to the first, except for the addition of panels 86 and 87.

Moreover, as shown in FIG. 10, additional "feet" 86 and 87 can be provided. When they are folded 90 degrees towards to viewer, the final assembly will allow them to provide further support for the floor 20.

To advise the public of the scope of this invention, we make the following claims.

Industrial Applicability

This invention has utility to display products to consumers at retail. It may also serve to provide storage boxes.

I claim:

1. A display having a sloped floor, comprising:

a box having first and second panels each having upper and lower edges as well as first and second lateral edges, and a third panel connecting a first panel lateral edge and a second panel lateral edge;

a floor panel integrally attached at a fold line to the first panel's lower edge;

a brace panel attached to the floor panel opposite the first panel; and a securer fastening the brace panel adjacent the second panel;

wherein the floor panel slopes downward from the rear of the display towards the front, and the brace panel supports the floor panel;

wherein the second panel includes a lower section, the lower section and the brace panel are brace components, the securer is formed by the brace components, a first of the brace components is a slit and a second of the brace components is a tab, and the tab extends through the slit to secure the brace panel adjacent the second panel;

said slit being formed in the lower section;

wherein the tab is formed on the brace panel and the length of the tab is essentially the same as the distance between the bottom of the slit and the second panel lower edge; and wherein the tab is positioned such that a downward end of the tab partially supports the floor panel.

2. The display of claim 1, wherein the third panel is a first lateral panel and the box further includes a fourth panel opposite the first lateral panel that is also essentially vertical and connects the first and second panels.

3. A display having a sloped floor, comprising:

a box having first and second panels each having upper and lower edges as well as first and second lateral edges, and a third panel connecting a first panel lateral edge and a second panel lateral edge;

a floor panel integrally attached at a fold line to the first panel's lower edge;

a brace panel attached to the floor panel along a fold line between the brace panel and the floor panel which is opposite the first panel, the brace panel having a downwardly projecting tab that is formed along an edge of the brace panel that is opposite said fold line between the brace panel and the floor panel; and a slit fastening the brace panel to the second panel, where the slit is in a lower section of the second panel and receives the tab;

wherein the floor panel slopes downward from the rear of the display towards the front, and the brace panel supports the floor panel; and wherein the tab is positioned such that a downward end of the tab partially supports the floor panel.

* * * * *